US008701760B2

(12) United States Patent
Parsche

(10) Patent No.: US 8,701,760 B2
(45) Date of Patent: Apr. 22, 2014

(54) ELECTROMAGNETIC HEAT TREATMENT PROVIDING ENHANCED OIL RECOVERY

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 448 days.

(21) Appl. No.: 13/163,225

(22) Filed: Jun. 17, 2011

(65) Prior Publication Data

US 2012/0318498 A1 Dec. 20, 2012

(51) Int. Cl.
*E21B 36/00* (2006.01)
*E21B 43/24* (2006.01)

(52) U.S. Cl.
USPC ..... 166/248; 166/302; 166/57

(58) Field of Classification Search
USPC ..... 166/248, 302, 57, 60
See application file for complete search history.

(56) References Cited

U.S. PATENT DOCUMENTS

| | | | | |
|---|---|---|---|---|
| 2,757,738 | A | 8/1956 | Ritchey | |
| 3,522,848 | A | 8/1970 | New | |
| 4,140,179 | A | 2/1979 | Kasevich et al. | 166/248 |
| 4,193,451 | A | 3/1980 | Dauphine | 166/248 |
| 4,196,329 | A * | 4/1980 | Rowland et al. | 219/772 |
| RE30,738 | E | 9/1981 | Bridges | |
| 4,433,724 | A | 2/1984 | Nagano et al. | |
| 4,485,869 | A | 12/1984 | Sresty et al. | 166/248 |
| 4,508,168 | A | 4/1985 | Heeren | 166/248 |
| 4,524,827 | A * | 6/1985 | Bridges et al. | 166/248 |
| 4,638,863 | A | 1/1987 | Wilson | |
| 4,793,409 | A * | 12/1988 | Bridges et al. | 166/57 |
| 4,821,798 | A * | 4/1989 | Bridges et al. | 166/60 |
| 5,236,039 | A | 8/1993 | Edelstein | |
| 5,299,887 | A | 4/1994 | Ensley | |
| 6,012,520 | A | 1/2000 | Yu et al. | |
| 7,055,599 | B2 * | 6/2006 | Kasevich | 166/248 |
| 7,091,460 | B2 | 8/2006 | Kinzer | |
| 2007/0289736 | A1 | 12/2007 | Kearl et al. | |
| 2008/0271890 | A1 | 11/2008 | Smith et al. | |
| 2009/0242196 | A1 | 10/2009 | Pao | |
| 2013/0153210 | A1 | 6/2013 | Menard et al. | |

FOREIGN PATENT DOCUMENTS

| | | |
|---|---|---|
| WO | 0250399 | 6/2002 |
| WO | 2007147050 | 12/2007 |
| WO | 2007147053 | 12/2007 |
| WO | 2010107726 | 9/2010 |

* cited by examiner

*Primary Examiner* — Giovanna Wright
(74) *Attorney, Agent, or Firm* — Allen, Dyer, Doppelt, Milbrath & Gilchrist, P.A.

(57) ABSTRACT

A method for using RF energy to facilitate the production of oil from formations separated from the RF energy source by a rock stratum comprises operating an antenna to transmit RF energy into a hydrocarbon formation, the hydrocarbon formation comprised of a first hydrocarbon portion above and adjacent to the antenna, a second hydrocarbon portion above the first hydrocarbon portion, and a rock stratum between the first hydrocarbon portion and the second hydrocarbon portion. The operation of the antenna heats water in the hydrocarbon formation to produce steam in the hydrocarbon formation, and the steam heats hydrocarbons in the hydrocarbon formation and fractures the rock stratum to produce fissures in the rock stratum. The heated hydrocarbons in the second hydrocarbon portion flows into the first hydrocarbon portion through the fissures in the rock stratum.

16 Claims, 8 Drawing Sheets

ELECTROMAGNETIC HEAT TREATMENT PROVIDING ENHANCED OIL RECOVERY

STATEMENT REGARDING FEDERALLY SPONSORED RESEARCH OR DEVELOPMENT

[Not Applicable]

BACKGROUND OF THE INVENTION

The present method and apparatus for electromagnetic heat treatment relates to the fracturing of a subsurface rock formations to access oil deposits and the heating of subsurface geological formations using radio frequency ("RF") energy to assist in the production of oil from those deposits. In particular, the present invention relates to a method for using RF energy to facilitate the production of oil from formations separated from other formations by a rock stratum.

Bituminous ore, oil sands, tar sands, and heavy oil are typically found as naturally occurring mixtures of sand or clay and dense and viscous petroleum. Recently, due to depletion of the world's oil reserves, higher oil prices, and increases in demand, efforts have been made to extract and refine these types of petroleum ore as an alternative petroleum source. Because of the extremely high viscosity of bituminous ore, oil sands, oil shale, tar sands, and heavy oil, however, the drilling and refinement methods used in extracting standard crude oil are typically not available. Therefore, bituminous ore, oil sands, oil shale, tar sands, and heavy oil are typically extracted by strip mining, or in situ techniques are used to reduce the viscosity by injecting steam or solvents in a well so that the material can be pumped. Under either approach, however, the material extracted from these deposits can be a viscous, solid or semisolid form that does not easily flow at normal oil pipeline temperatures, making it difficult to transport to market and expensive to process into gasoline, diesel fuel, and other products. Typically, the material is prepared for transport by adding hot water and caustic soda (NaOH) to the sand, which produces a slurry that can be piped to the extraction plant, where it is agitated and crude bitumen oil froth is skimmed from the top. In addition, the material is typically processed with heat to separate oil sands, oil shale, tar sands, or heavy oil into more viscous bitumen crude oil, and to distill, crack, or refine the bitumen crude oil into usable petroleum products.

Steam is typically used to provide this heat in what is known as a steam assisted gravity drainage system, or SAGD system. Electric heating has also been employed. Such conventional methods of heating bituminous ore, oil sands, tar sands, and heavy oil suffer from numerous drawbacks. For example, the conventional methods typically utilize large amounts of water, and also large amounts of energy. Moreover, using conventional methods, it has been difficult to achieve uniform and rapid heating, which has limited successful processing of bituminous ore, oil sands, oil shale, tar sands, and heavy oil. SAGD systems may not be practical: (1) where there is insufficient caprock to contain the steam; (2) in permafrost regions; or (3) where the steam may be lost to thief zones. Conductive heating may be required to initiate the fluid movement to convect the steam, yet conductive heating is slow and unreliable such that may SAGD wells do not start. It can be desirable, both for environmental reasons and efficiency/cost reasons to reduce or eliminate the amount of water used in processing bituminous ore, oil sands, oil shale, tar sands, and heavy oil, and also provide a method of heating that is efficient and environmentally friendly, which is suitable for post-excavation processing of the bitumen, oil sands, oil shale, tar sands, and heavy oil. The heating and processing can take place in-situ, or in another location after strip mining the deposits.

RF heating many offers advantages over the above-described methods when heating bitumen. RF energy can be targeted, and reduces or eliminates the large amounts of water used in many other methods. Unlike steam, RF heating does not require convection to convey the heat energy. Thus, start-up is reliable.

Antennas used for prior RF heating of heavy oil in subsurface formations have typically been dipole antennas. U.S. Pat. Nos. 4,140,179 and 4,508,168 disclose prior dipole antennas positioned within subsurface heavy oil deposits to heat those deposits. Arrays of dipole antennas have also been used to heat subsurface formations. U.S. Pat. No. 4,196,329 discloses an array of dipole antennas that are driven out of phase to heat a subsurface formation.

RF energy has been used to heat oil shale with the goal of producing gas and shale oil from kerogen contained in the shale. U.S. Pat. No. 4,193,451 discloses subjecting a body of oil shale to RF in the form of alternating electric fields having frequencies in the range of 100 kilohertz to 100 megahertz to produce controlled heating of kerogen in the oil shale. This heating may produce fissures in the oil shale, however, U.S. Pat. No. 4,485,869 discloses that those fissures are undesirable and teaches heating the oil shale relatively slowly to produce relatively little cracking of the oil shale.

Underground permeation is often inadequate in oil sand formations, largely due to the presence of rock strata in the formations. Often comprised of shale, these rock strata can impede the production of hydrocarbons from oil bearing formations when using traditional processing methods, such as SAGD systems. Such split pay zones are a large problem in the Athabasca oil sands. Shale in underground formations is a porous rock that typically contains internal water content and is characterized by thin laminae internally. In processing non-oil sand formations, rock strata is sometimes fractured using hydrofracturing, chemicals, or explosives. However, these methods of fracturing rock strata are not well suited to the recovery of oil from oil sands because, respectively, they require an on-site water source where there may be none, they require dangerous and expensive chemicals, or the thin, oil-bearing ore in these deposits may be damaged by the explosives used to fracture the rock strata present in the formation.

SUMMARY OF THE INVENTION

In one embodiment, a method for using RF energy to facilitate the production of hydrocarbons from a hydrocarbon formation where the hydrocarbons are separated from the RF energy source by a rock stratum comprises operating an transmitting RF energy into a hydrocarbon formation, the hydrocarbon formation comprised of a first hydrocarbon portion above and adjacent to the antenna comprising hydrocarbons, a second hydrocarbon portion above the first hydrocarbon portion comprising hydrocarbons, and a rock stratum between the first hydrocarbon portion and the second hydrocarbon portion, the rock stratum comprising water and rock. The RF energy heats the first and second hydrocarbon portions and creates fissures in the rock by heating the water in the rock stratum to produce steam that fractures the rock. The heated hydrocarbons in the second hydrocarbon portion flow through fissures in the rock stratum and are recovered along with hydrocarbons from the first hydrocarbon portion.

The antenna may comprise operating an uninsulated, linear dipole antenna powered by an alternating current power source and operated at a frequency of 60 Hz or lower to provide Joule effect heating of at least a portion of the hydrocarbon formation. Alternatively, the antenna may comprise operating an uninsulated, linear dipole antenna powered by a direct current power source to provide Joule effect heating of at least a portion of the hydrocarbon formation. As the water boils off, the frequency of the uninsulated, linear dipole antenna powered by the alternating current power source may be raised to a frequency in the range of 3-30 MHz to provide dielectric heating to at least a portion of the hydrocarbon formation.

In another embodiment, the antenna may comprise a conductively insulated, linear dipole antenna powered by an alternating current power source and operated at a frequency of about 30 MHz to provide dielectric heating of at least a portion of the hydrocarbon formation. The conductive insulation around the antenna may comprise Teflon.

The antenna in yet another embodiment may comprise a loop antenna powered by an alternating current power source and operated at a frequency in the range of about 1 to 50 KHz to provide resistance heating of at least a portion of the hydrocarbon formation.

The antenna in another embodiment may comprise a linear dipole antenna powered by an alternating current power source and conductively insulated by steam surrounding the antenna, and operated at a frequency in a range between 3 and 30 MHz to provide Joule effect heating of at least a portion of the hydrocarbon formation.

The antenna in the various embodiments may comprise oil well piping, and may be powered by either an alternating current power source or a direct current power source. The rock stratum may comprise coal, alluvial shale, or other types of water bearing rock.

Other aspects of the invention will be apparent from this disclosure.

DETAILED DESCRIPTION OF THE PREFERRED EMBODIMENTS

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Figure 1:
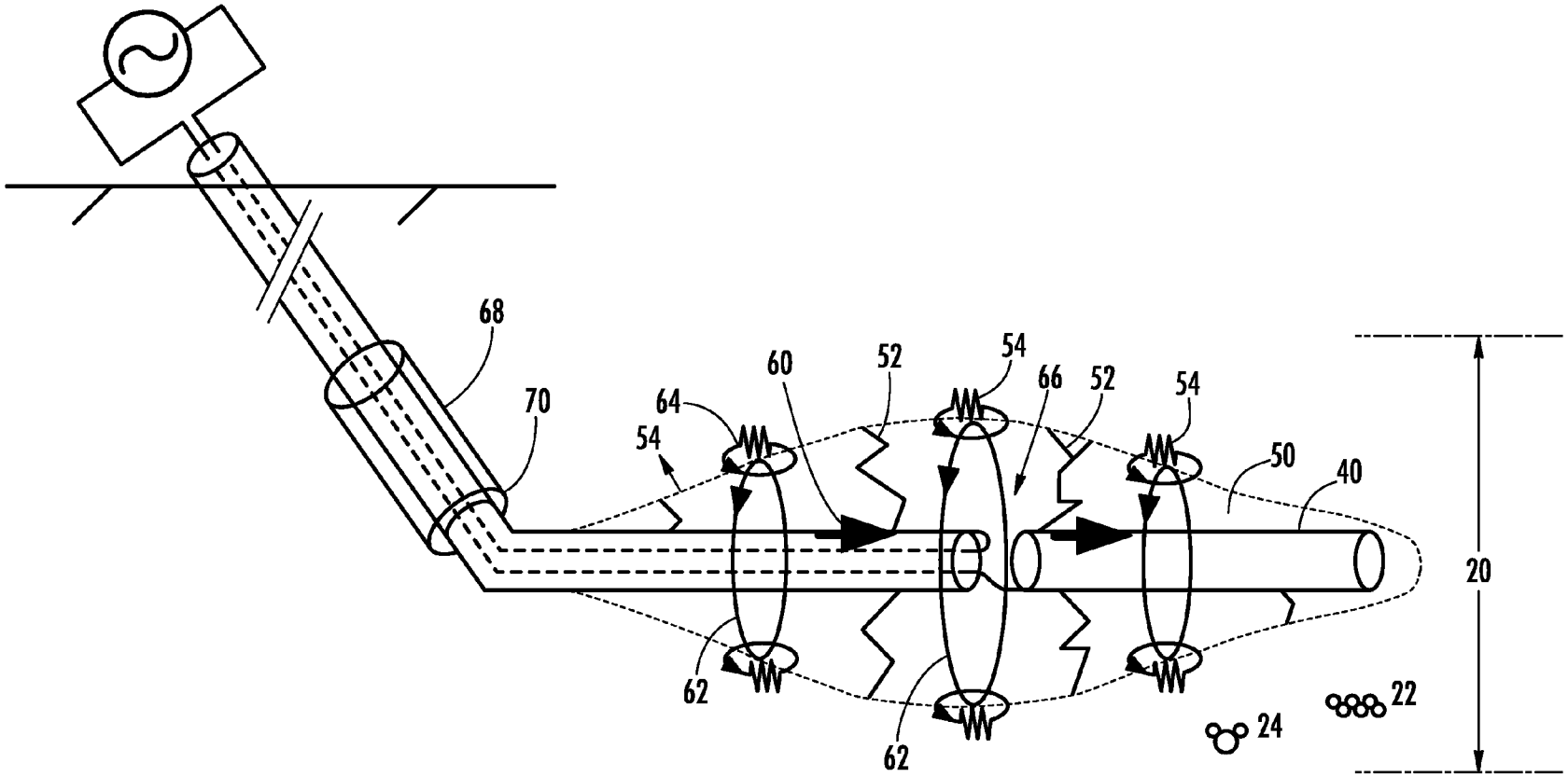
FIG. 1 depicts an embodiment of the present method of electromagnetic heat treatment.

Referring to FIG. 1 an antenna 40 is depicted below surface 10. Antenna 40 may be a linear structure such as a dipole, coaxial or sleeve dipole or a dipole antenna including a folded or loop circuit to convey an RF electric current 60 in a closed circuit. In this embodiment, SAGD well piping 30 is utilized as the antenna. A conductive choke sleeve 68, for example a metal pipe, may be connected to the antenna 40 at conductive bond 70 to stop electric currents from reaching the surface. Antenna 40 is electrically connected to power source 15. Antenna 40 may include a driving discontinuity 66 or other means fo forcing the current flow, such as a gamma match. RF electric current 60 flows on the surface of antenna 40 transducing a circular magnetic near field 62 circumferentially around the antenna 40 according to Ampere's Law. The circular magnetic near field 62 next creates eddy electric currents 64 in the underground strata, preferentially a rock or coal strata 20 containing natural gas 22. The eddy electric currents 64 pass through the electrical resistance of the in situ liquid water 24 causing heating by joule effect. Thus, a compound method is provided by the invention to convey the electrical energy to the ore without electrode contact. This linear (line-shaped) antenna provides magnetic near field induction heating in an underground strata.

Over time the realized temperatures underground reach the steam saturation temperature at reservoir conditions so the in situ liquid water 24 becomes steam as it changes phase, e.g. a steam saturation zone 50 forms in the earth around the antenna 40. The steam saturation zone 50 may be thought of as a captive steam bubble diffused in a rock or coal strata 20, and the steam causes the pore pressure in the rock or coal strata 20 to rise. This rising ore pressure stresses the rock or coal strata 20 until the strain exceeds tensile strength of the rock or coal strata 20 and brittle fracture ensues. Cracks and fissures 52 are rendered in the rock or coal strata 20 formation as a result. Cracks and fissures 52 increase the permeation of the rock or coal strata 20 to permit the flow of natural gas 22 for resource recovery. Rock may include, for example, alluvial shale.

The steam saturation zone 50 is a low loss media for the propagation of electromagnetic energy and in specific it allows the expansion of magnetic near fields and electric near fields to reach the wall of the steam saturation zone 50. Thus a heating front 54 is caused to expand at the wall of the steam saturation zone 50 over time. A steep thermal gradient occurs at the wall of the steam saturation zone 50 as the RF heat energy penetrates faster than the conducted heating energy. This rapid heating at the heating front 54 is most conducive to accomplishing thermal shock and forming and propagating rock fractures 52. The speed of the RF heating is superior to conduction and convection with steam and the RF heating energy such as electric and magnetic fields are effective in penetrating impermeable formations where steam cannot penetrate.

The radio frequencies may be in the Very Low Frequency to High Frequency range—from about 3 KHz to 30 MHz. These radio frequencies are superior to microwaves as they result in increased penetration and easy of energy delivery. They are also superior to the 60 Hertz power grid frequencies as they can transduce any required electrical load resistance from the ore as the frequency may be varied. RF power levels may be range from 1 to 20 kilowatts per meter of well length and the heating may be performed in weeks or months. The applied power and duration of power application adjusts size of the steam saturation zone 50 to encompass, or further encompass oil formations stranded on the opposite side of the rock from antenna 40. This may also increase the extent of the cracks and fissures 52 in the rock, and provide heat to melt solid hydrocarbons to stimulate production.

Direct conduction of electric currents from the antenna surface is not essential using the present method. Thus, the heating is reliable as opposed to DC and 60 Hertz techniques, which may be unreliable as the in-situ water can boil off the antenna surfaces and lose electrode contact. In the present method, the energy is conveyed by the expansion of electric and magnetic fields, preferentially by electric near fields and magnetic near fields, so ionic conduction at the antenna conductor surfaces is not essential. The present method of electromagnetic heat treatment is not so limited as to preclude the use of electromagnetic waves that may later form as the steam saturation zone 50 grows to a significant fraction of a wavelength in radius.

The present method of electromagnetic heat treatment may utilize various antenna configurations and multiple types of heating. For example, referring to FIG. 2, this configuration may be used for wet rock formations 138 comprising liquid phase water in-situ in the rock. An uninsulated, linear dipole antenna 140 is in conductive contact with a target media in the formation represented by resistive load 144, which includes rock stratum 138. Here, the target media is liquid phase water. The antenna 140 here may be operated using commercial, 60 Hz AC power or lower frequencies, e.g., 3 KHz, or DC power introduced by source 136. Current 142 flows into resistive load 144 and current 146 flows out of resistive load 144. The liquid water is heated in heating zone 148 by resistive heating, i.e. the Joule effect (Heat=$I^2R$). This is a relatively slow heating with a relatively large penetration depth into the formation. The uninsulated surfaces of the antenna 40 provide electrode-like contact with the formation. Although a combination of conducted currents, the magnetic near fields and electric near fields will typically be transduced, and the conducted electric current 142 is predominant in effect.

Figure 2:
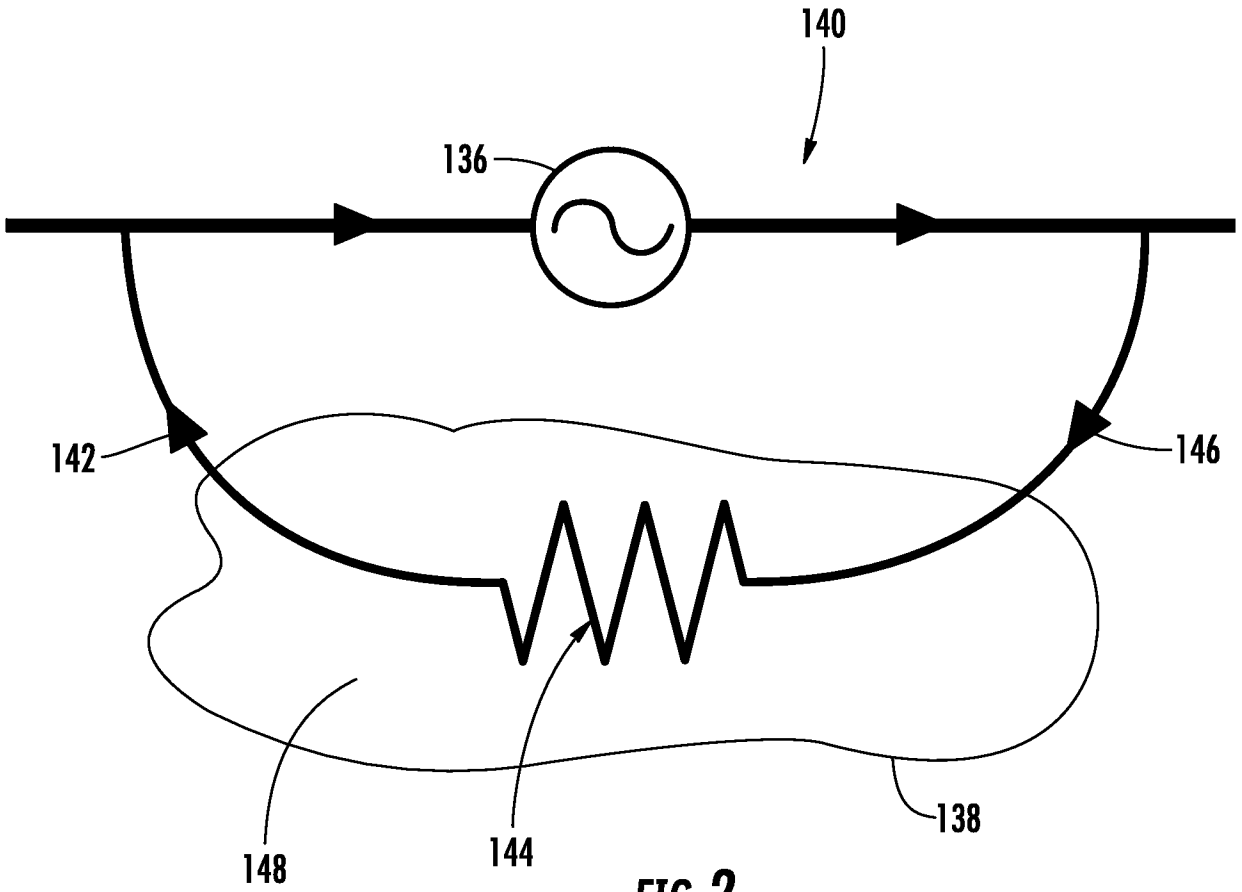
FIG. 2 depicts resistive heating using an uninsulated, linear dipole antenna.
Figure 3:
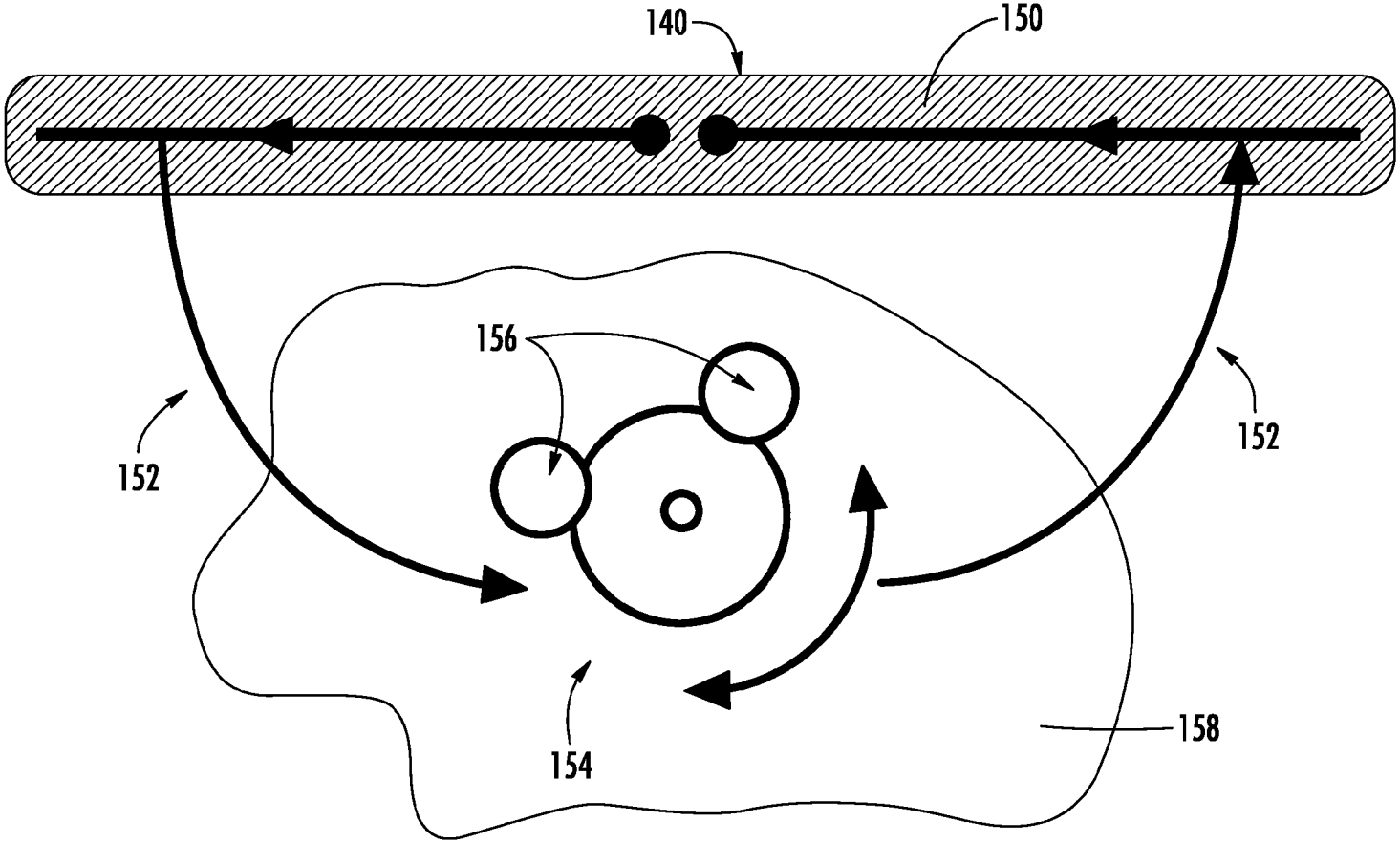
FIG. 3 depicts dielectric heating using an insulated linear dipole antenna.

FIG. 3 depicts dielectric heating associated with an embodiment of the present electromagnetic heat treatment. Here, linear dipole antenna 140 is insulated with nonconductive insulation 150. This nonconductive insulation may be, for example, Teflon or polyethelene, glass, ceramics, asbestos, etc. Thus, linear dipole antenna 140 does not conductively contact the target media, e.g., polar water molecules 154 in hydrocarbon formations and rock strata 138. Linear dipole antenna 140 may also have become electrically insulated due to the formation of an underground steam saturation zone, e.g. the water may have boiled off of the antenna surfaces. Polar water molecule 154 is in-situ with the hydrocarbons 156. Relatively high radio frequencies are required here, e.g., on the order of 30 MHz or higher. When insulated antenna 140 generates electric fields 152, polar water molecules 154 in heating zone 158 are heated, which in turn heat the hydrocarbons 156 by thermal conduction. This dielectric heating may be used in relatively low liquid water content formations, and generally results in faster heating and shallower penetration that the resistive heating of FIG. 2. Linear dipole antenna 140 transduces one or more of the following: two electric near fields (one radial and one circular); one electric middle field; and an electric far field.

The resistive heating of FIG. 2 will begin to fail when the liquid water boils off or if the antenna becomes coated with asphaltine. However, dielectric heating similar to that described in conjunction with FIG. 3 may be achieved by applying high frequency direct current to linear dipole antenna 140, e.g., on the order of 3-300 MHz. Thus, a shift in frequency and electromagnetic heating mode is anticipated as the heating progresses in order to manage the phase of the in-situ water.

Figure 4:
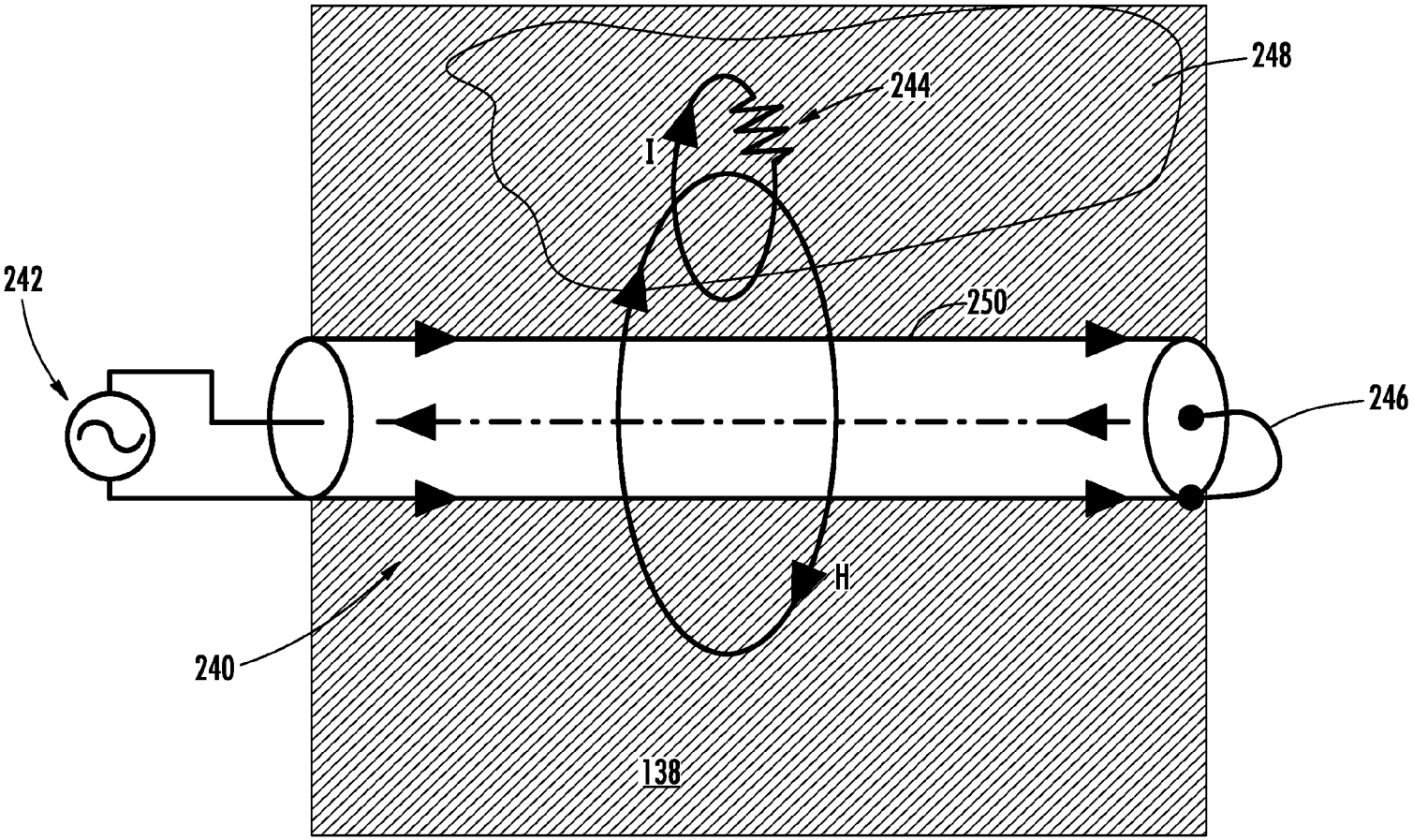
FIG. 4 depicts induction heating using a loop or folded antenna.

Turning now to FIG. 4, loop or folded antenna 250, powered by power source 242, generates an electrical current (represented by arrows on outer antenna tube 250) that causes a magnetic induction field (H). Electrical fold 246 creates a loop antenna from a linear structure, such as a well pipe. The electrical current 250 in turn causes eddy current (I) to flow in the ore 244. This eddy current flow results in resistance heating (e.g. $I^2R$ or joule effect heating) in the ore 244 located in heating zone 248. This embodiment may be operated, for example, at frequencies of about 1 to 50 KHz. Liquid phase water in rock 138 is the target susceptor. Reliable performance occurs as no conductive contact is required to media. The embodiment in FIG. 4 avoids concerns of water boil-off at electrodes or loss of electrical contact due to asphaltine deposition. The coaxial folded circuit antenna 250 advantageously provides magnetic induction heating from a single well bore, and the need for costly underground antenna structures such as rectangular loops or coils is avoided.

Figure 5:
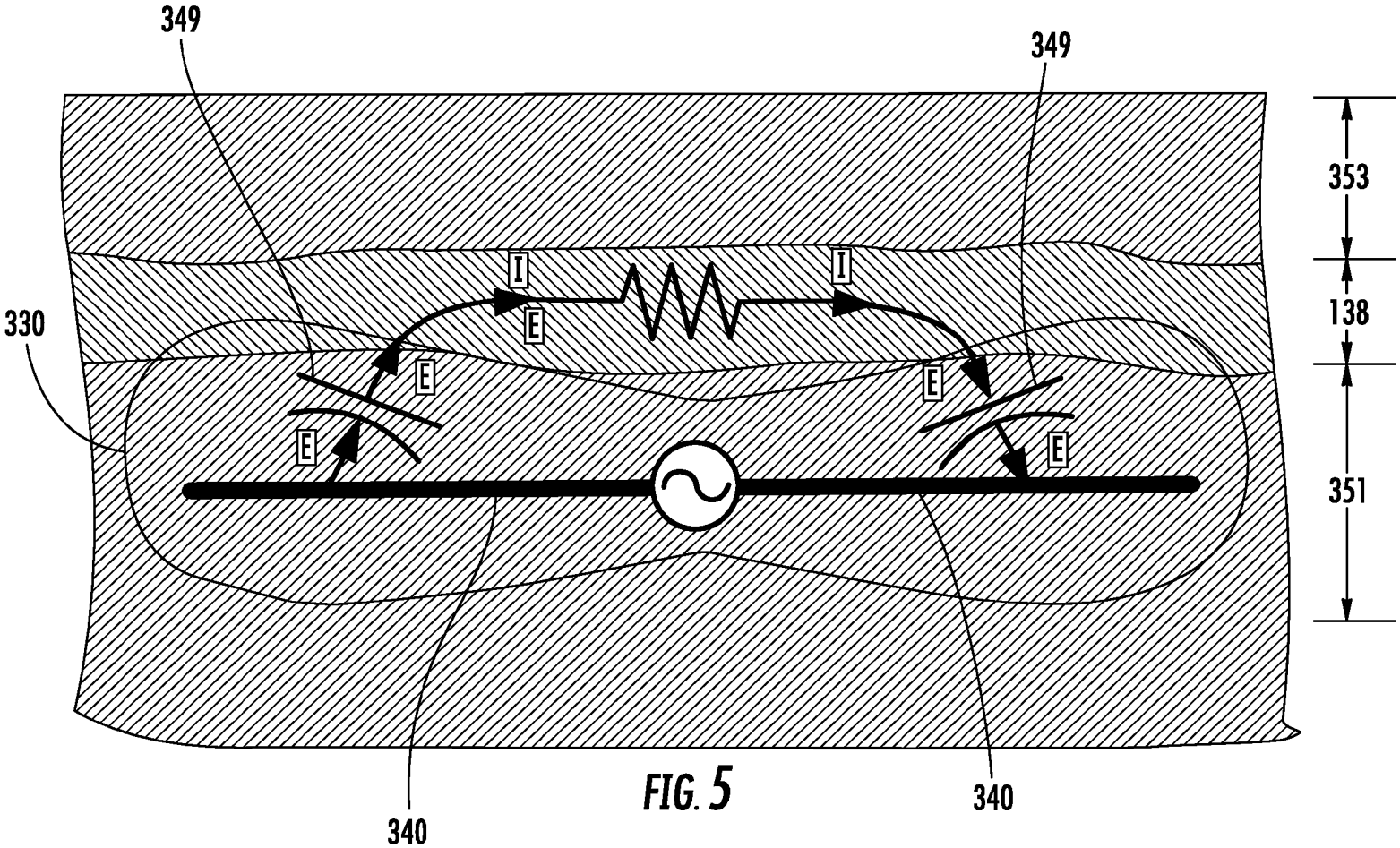
FIG. 5 depicts displacement current heating using a linear antenna.

FIG. 5 depicts an embodiment employing electric near fields and capacitive coupling to displacement current. In FIG. 5, a steam saturation zone 330 is formed by the injection of steam from the surface or alternatively by RF heating around a linear electrical conductor 340 carrying a radio frequency electrical current I to form steam bubble 344. Electrical conductor 340 may be comprised from various electrically conductive structures such as a wire dipole antenna, a coaxial (sleeve) dipole antenna, or a well pipe carrying the radio frequency electrical current. Steam bubble 344 effectively insulates electrical conductor 340 from conductive contact with the target susceptor, i.e., liquid phase water in rock 138. Electric near fields (E) penetrate the nonconductive steam bubble 344 coupling to rock 138 by capacitance 349 which exists between the electrical conductor 340 and rock 138. The electric near field coupling between the linear electrical conductor 340 and the conductive liquid water in rock 138 produces an electric conduction current (J) flow in the rock 138, e.g. an electron flow. Heating in rock 138 is by resistive means by Joule effect ($I^2R$) as the electric fields (E) in the steam bubble 344 convert to electric conduction currents (J) in the more electrically conductive rock 138 and the hydrocarbons 351. The FIG. 5 displacement current embodiment advantageously heats the higher electrical conductivity rock strata quicker than the hydrocarbons 351, which leads to quicker rock 138 fracture. The synergistic heating of the rock 138 occurs with or without formation of the steam bubble 344, because the rock 138 is generally much more conductive than the hydrocarbons 351. Over time the heating can progress into the stranded hydrocarbons 342 beyond if desired.

The displacement current method of heating in FIG. 5 also provides a higher resistance electrical load than that of FIG. 2, and therefore smaller, less expensive wires may be used. Typically, frequencies in this embodiment range between 0.3 and 30 MHz. Higher conductivity ores may use higher frequencies and lower conductivity ores lower frequencies. Due to the low electrical conductivity of the steam bubble 344 DC or 60 Hertz is impractical here. As background and for instance, Athabasca oil sand formations are often stratified with rock or shale layers. A displacement current can be thought of as the internal an electric field providing electric current flow through a capacitor at radio frequencies. Electric fields in a conductive media is quickly converted to an electric currents.

Figure 6:
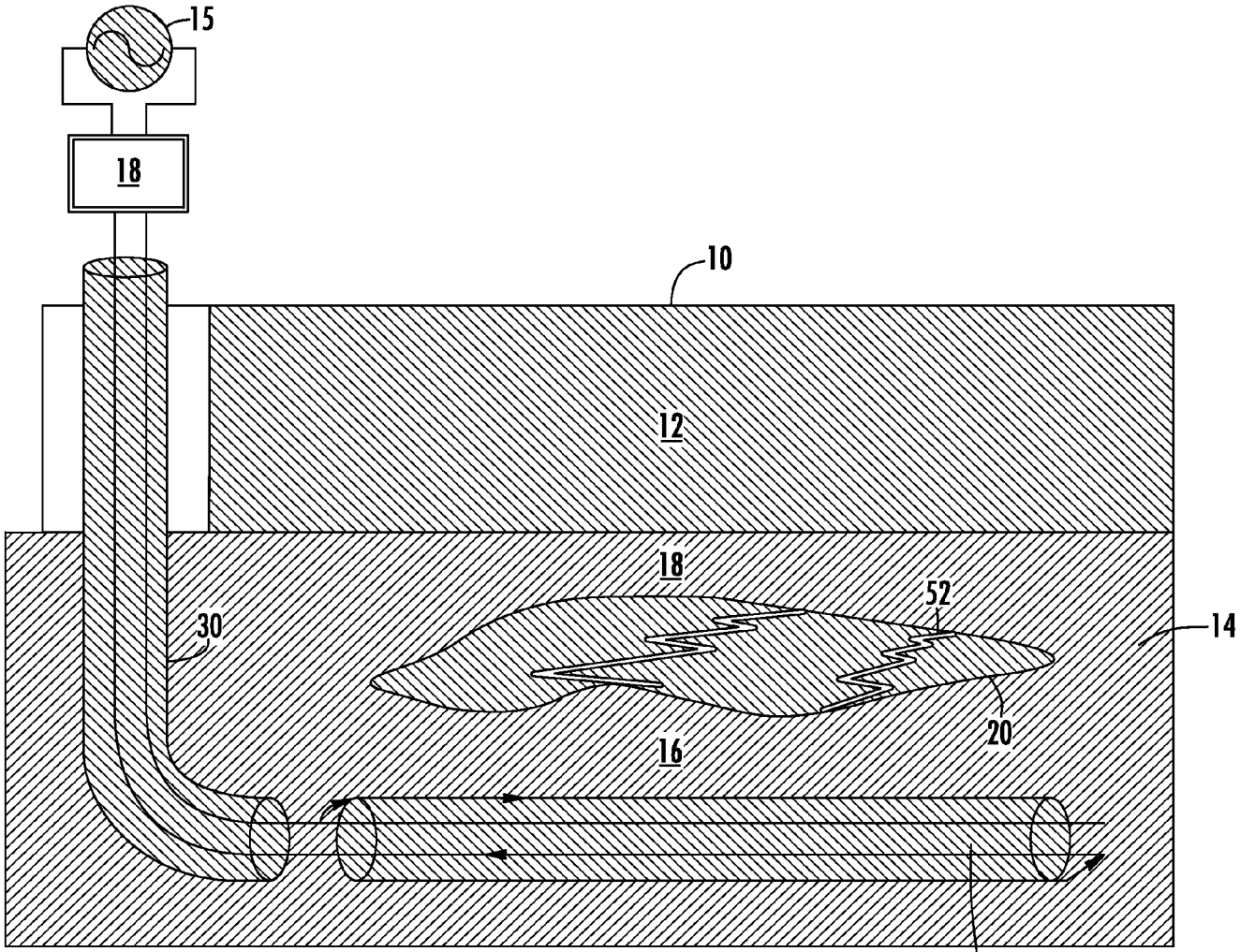
FIG. 6 depicts a physical arrangement of the antenna and geological formations involved in one embodiment of the present method of electromagnetic heat treatment.

As seen in FIG. 6, heating zones 148, 158, 258 and 358 may comprise a hydrocarbon formation 14 comprising a first hydrocarbon portion 16 adjacent antenna 40, a rock stratum 20, and a second hydrocarbon portion 18 on the opposite side of rock stratum 20 from antenna 40 and below overburden 12. The hydrocarbon portions in this embodiment are oil sands.

Antenna 40 utilizes a portion of SAGD well piping 30 and is powered by power source 15. Antenna 40 provides a loop circuit from a conductive pipe, which may be a straight pipe. Impedance matching circuitry 18 is employed in this embodiment. As RF energy from antenna 40 heats water in the hydrocarbon formation 14, steam heats the hydrocarbon portions 16 and 18 and fractures rock stratum 20 to form fissures 52. Heated hydrocarbon in the oil sands may then flow through fissures 52 for recovery from a location at or near antenna 40. Here, SAGD piping 30 may be utilized to produce the heated hydrocarbons at the surface 10.

The electrical conductivity of a shale layer in rich Athabasca oil sand may be 0.02 mhos/meter or more, and the rich oil sand 0.002 mhos/meter such that the rock or shale layer RF heats preferentially to the oil sand. This is synergy of the present embodiments as the radio frequency electromagnetic heating targets rock heating to bring the connate water therein to the boiling temperature at reservoir conditions.

Figure 7:
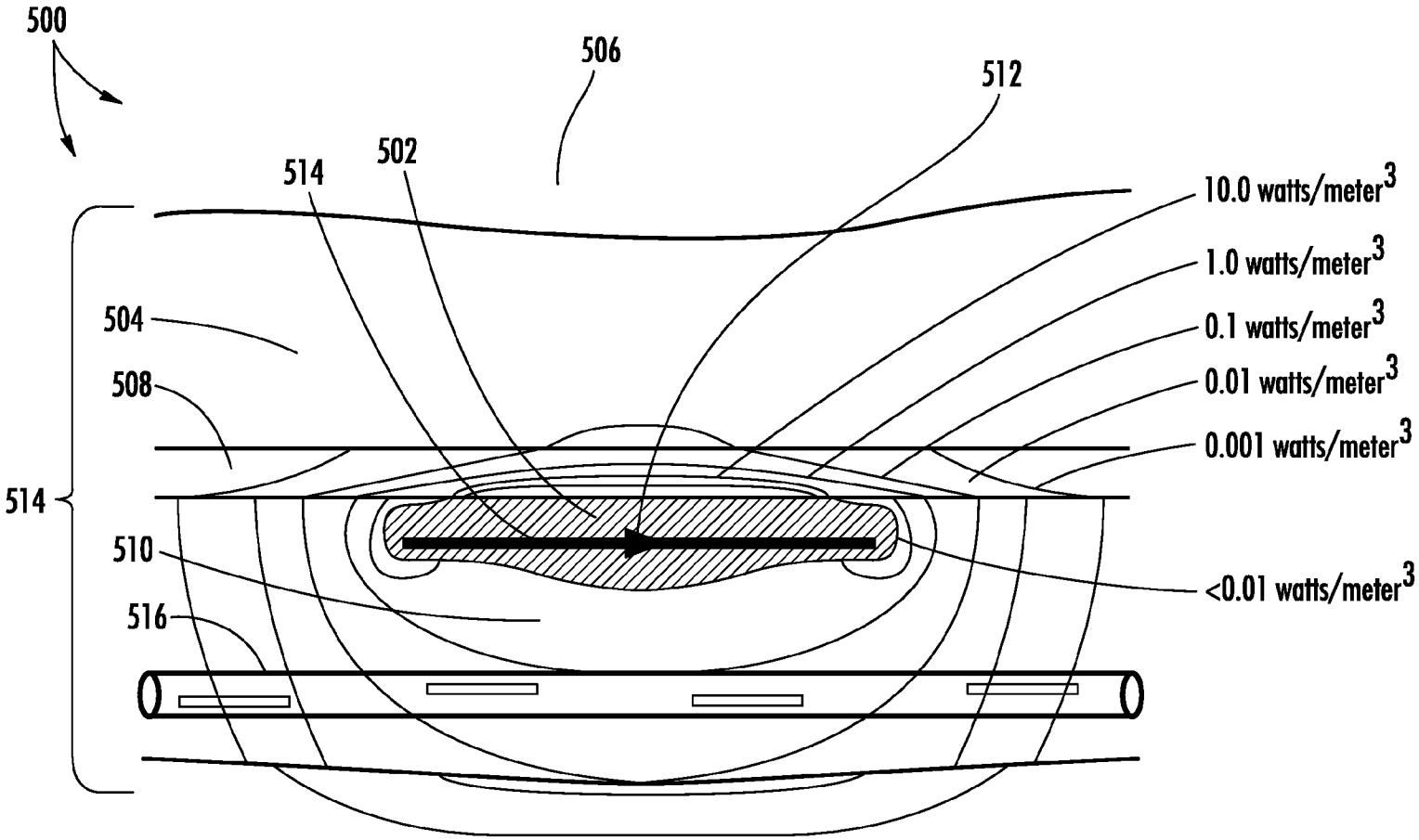
FIG. 7 is an example contour plot of heating rates using a linear antenna located in an oil sand formation.

FIG. 7 is an example of RF heating used to break underground rock. The example is general in nature, and intended to depict the utility of RF energy to target and break underground rock. The present method is, of course, useful for many resources including coal, natural gas formations, and crude oils. Turning now to FIG. 7, an underground formation 500 includes a stratified hydrocarbon reservoir 514. An upper strata 504 and lower strata 510 comprised of rich Athabasca oil sand are separated by an impermeable rock layer 508, such as shale. A bedrock formation 518 is located at the bottom of the formation and an overburden 508 at the top. A producer well pipe 516 is located in the lower strata 510.

As should be appreciated, rock layer 508 ordinarily would make it difficult, if not impossible, to produce hydrocarbons from the upper strata 504. Upper strata 504 is therefore a stranded resource. In order to access this stranded resource, linear antenna 514 is located in a lower strata 510 and a radio frequency electric current 512 is applied and conveyed along a linear antenna 514 for the purposes of RF heating. In this example, the linear antenna 514 should be regarded as notional and many of the mechanical details are not shown for the sake of clarity. The overall length of the linear antenna 514 is 20 meters long and the linear antenna 514 has a diameter of 0.25 meters. The linear antenna 514 is surrounded by a nonconductive electrical insulation (not shown) having a diameter of 0.5 meters which may be say fiberglass or air. In the FIG. 7 analysis the upper strata 504 and lower strata 510 are rich oil sand formations having an electrical conductivity of 0.002 mhos/meter and a real component relative dielectric constant of 6.0, which are typical parameters at high frequencies (HF).

The impermeable rock layer 508 has an electrical conductivity of 0.20 mhos/meter. Rock formations typically are much more electrically conductive than oil bearing formations, often by a factor of 100 to 1 or more. The radio frequency being applied is 4.0 MHz, and the antenna is at fundamental resonance. The current distribution along the linear antenna 514 is sinusoidal and there is a current maxima at the antenna center and current minima at the antenna ends. The power being accepted by the antenna is 100 kilowatts or 5000 watts per meter of antenna length. Over time, a steam saturation zone 502 grows around the linear antenna 514, which enhances the propagation and penetration of the electric and magnetic energy. There is also propagation of the electric and magnetic fields without the steam saturation zone. The heat may also propagate by conduction and convection.

Volume loss density contours are shown in FIG. 7. These map the rate of heating energy being delivered to the formation in units watts/meter cubed. The heating rate inside the steam saturation zone 502 is generally less than about 0.1 watts per meter as vapor phase water is not electrically conductive below the breakdown potential. As can be seen there are minor "hotspots" near the ends of the linear antenna 514*b* due to E field displacement currents and a larger "hotspot" broadside the antenna center due to H field induction of eddy electric currents. Note that the heating energy has advantageously become concentrated in the rock formation layer 508. This is due to rock formation layer 508 having higher electrical conductivity than the hydrocarbon bearing strata, its ability to capture E fields for displacement current coupling/heating, and rock formation layer 508's increased ability to transduce H fields into eddy electric currents.

A steep thermal gradient is caused in the rock formation layer 508 and this further enhances the shattering effect on the rock. The realized temperatures (not shown) are a function of time and the applied power. When boiling occurs the internal pressure inside the rocks rises dramatically. Brittle fracture of the rocks follows, which causes fissures and increased permeability. The RF heating is maintained until sufficient permeation is obtained. Rock fracture may also occur prior to reaching the boiling temperature due to thermal gradient.

Figure 8:
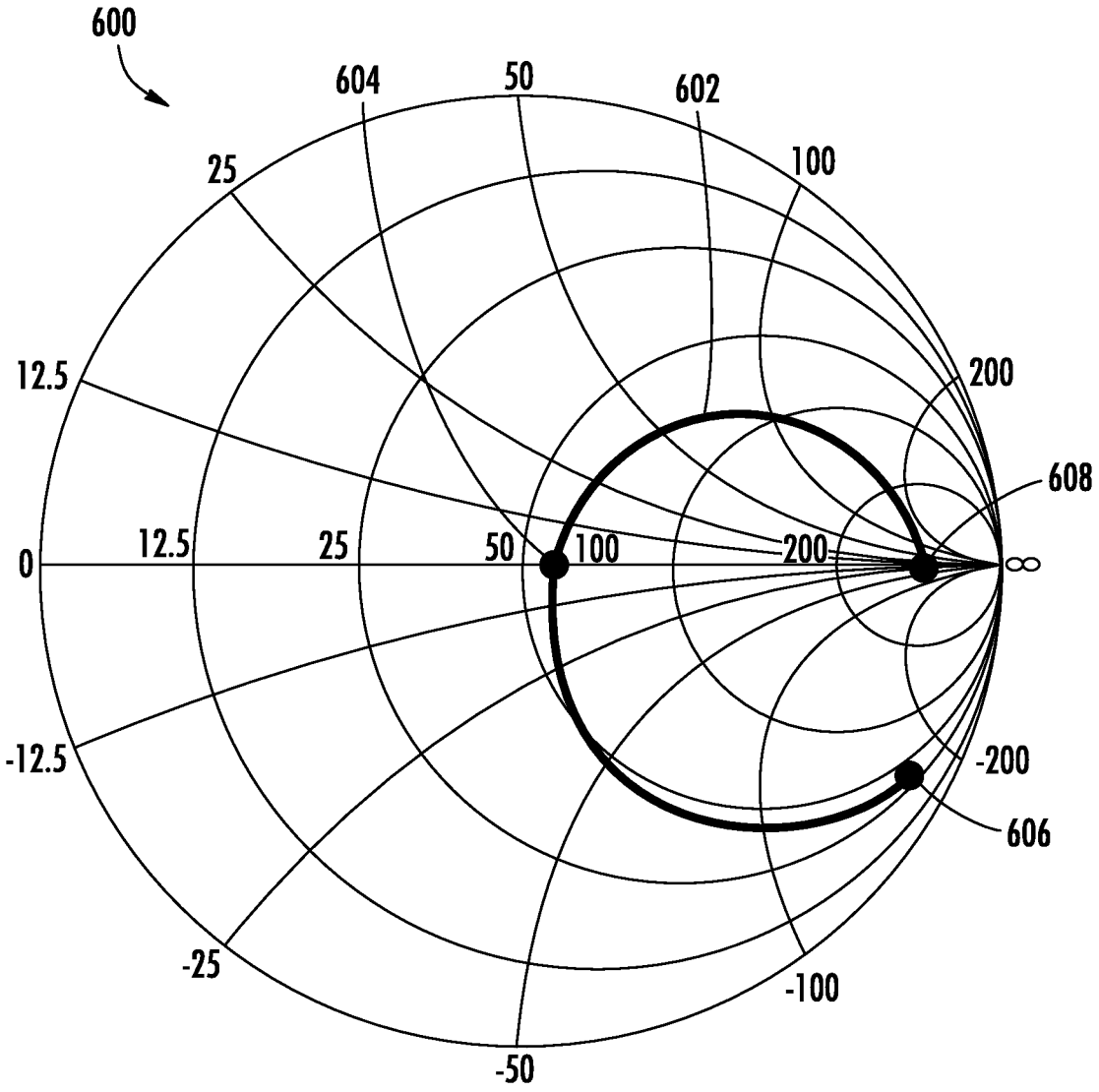
FIG. 8 is an example of the electrical load impedance of a linear antenna in an oil sand formation.

FIG. 8 is a vector impedance diagram of an insulated, center fed, half wave, linear antenna performing underground heating in rich Athabasca oil sand. The vector impedance diagram has a Smith Chart type coordinate system and the resistance and reactance of the antenna indicated in units of ohms. The antenna in the example is 20 meters in overall length.

The impedance plot 602 starts at 2 MHz and ends at 8 MHz which are points 606 and 608 respectively. Resonance occurred at point 604 which was almost exactly 4.0 MHz. The driving point impedance of the antenna at the 4.0 MHz resonance is Z=55-0.5 j ohms, which corresponds to resonance and a VSWR in a 50 ohm system of 1.1 to 1. Thus, even a simple underground antennas appear to provide a useful electrical load. The present method may track the antennas resonant frequency over time to quantify the water content present in the formation, as well as the progress of the heating and rock breaking. The same antenna would have had fundamental resonance in air near 8.0 MHz. Therefore, the length for resonance was shorted by about 50 percent by the oil sand.

As background, the situ underground water is usually the predominant factor in the electromagnetic heating characteristics of an underground formation. This is because the electromagnetic loss factor of water is generally 100 times or more higher than any hydrocarbon or rock solid such as quartz, carbonates or oxides. In highly distilled water, dielectric losses (heating effects due to E fields) are at a minima near 30 MHz (loss tangent near 0.002) and near a maxima at 24 GHz (loss tangent near 10.0). The dielectric losses of highly distilled water rise again below 30 MHz and are near 10.0 at 10 KHz. Dielectric heating of water is possible at many frequencies, and this response allows the choice of radio frequency to control the prompt penetration depth.

For instance the consumer microwave oven may operate at 2.45 GHz as most food would only be browned on the surface at 24 GHz. Operation near the 30 MHz water dielectric antiresonance is a method of the embodiments of the invention for increased penetration in underground formations containing nonconductive water or nearly so. In practice, most underground hydrocarbon formations include water having significant electrical conductivity, and in this case joule effect losses due to the motion of electric currents (charge transfer) can predominate over water molecule dielectric moment (molecular rotation). If the underground water is fresh and without salt the water conductivity is frequently due to dissolved carbon dioxide picked up in the rain through the atmosphere. Many underground waters are in fact a weak solution of carbonic acid. Electrical conductivity of 0.002 mhos/meter is not uncommon due to dissolved carbon dioxide. Formations containing saltwater can have much higher electrical conductivity. The present method advantageously allows a wide choice of electromagnetic heating modes and radio frequencies so heating can be reliable.

An easily reproduced demonstration of the efficacy of electromagnetic energy to break rocks was performed as follows. A sample of black shale from Athabasca Province Canada, which measured 5 by 7 by 0.32 inches, was soaked in saltwater for 48 hours and then placed in a consumer microwave oven (2450 GHz, 1000 watts nominal). The microwave oven was operated remotely for personnel safety. After 16 seconds of heating violent shattering was heard. Electric power was turned off at 18 seconds. Upon examination, the black shale sample was observed to have split in many places with multiple fissures visible both with and across the lamina.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged either in whole or in part. Therefore, the spirit and scope of the appended claims should not be limited to the description of the preferred versions contained herein.

The invention claimed is:

1. A method of recovering hydrocarbons from a hydrocarbon formation, the method comprising:

transmitting RF energy into the hydrocarbon formation using an antenna laterally extending within the hydrocarbon formation, the hydrocarbon formation comprising a first hydrocarbon portion above and adjacent the antenna and comprising hydrocarbons, a second hydrocarbon portion above the first hydrocarbon portion and comprising hydrocarbons, and a rock stratum between the first hydrocarbon portion and the second hydrocarbon portion, the rock stratum comprising water and rock;

the RF energy being transmitting into the hydrocarbon formation so that the first and second hydrocarbon portions are heated, water in the rock stratum is heated and steam is produced, and fissures are created in the rock based upon the steam fracturing the rock; and recovering the hydrocarbons from the first and second hydrocarbon portions, wherein heated hydrocarbons in the second hydrocarbon portion flow through the fissures in the rock stratum.

2. The method of claim 1, wherein the antenna comprises an uninsulated, linear dipole antenna, and wherein the RF energy is transmitted via the uninsulated, linear dipole antenna at a frequency of 60 Hz or lower to provide Joule effect heating of at least a portion of the hydrocarbon formation.

3. The method of claim 1, further comprising transmitting direct current via an uninsulated, linear dipole antenna to provide Joule effect heating of at least a portion of the hydrocarbon formation.

4. The method of claim 1, wherein the antenna comprises an uninsulated, linear dipole antenna, and wherein the RF energy is transmitted via the uninsulated, linear dipole antenna at a frequency in the range of 3-30 MHz to provide dielectric heating to at least a portion of the hydrocarbon formation.

5. The method of claim 1, wherein the antenna comprises a conductively insulated, linear dipole antenna, and wherein the RF energy is transmitted via the conductively insulated, linear dipole antenna at a frequency of about 30 MHz to provide dielectric heating of at least a portion of the hydrocarbon formation.

6. The method of claim 5, wherein insulation around the conductively insulated, linear dipole antenna comprises polytetrafluoroethylene.

7. The method of claim 5, wherein insulation around the conductively insulated, linear dipole antenna comprises steam.

8. The method of claim 1, wherein the antenna comprises a loop antenna, and wherein the RF energy is transmitted via the loop antenna at a frequency in the range of about 1 to 50 KHz to provide resistance heating of at least a portion of the hydrocarbon formation.

9. The method of claim 1, wherein the antenna comprises a linear dipole antenna conductively insulated by steam surrounding the linear dipole antenna, and wherein the RF energy is transmitted via the linear dipole antenna at a frequency in a range between 3 and 30 MHz to provide Joule effect heating of at least a portion of the hydrocarbon formation.

10. The method of claim 1, wherein the antenna comprises oil well piping.

11. The method of claim 1, wherein the rock stratum comprises alluvial shale.

12. An apparatus for recovering hydrocarbons from a hydrocarbon formation, the hydrocarbon formation comprising a first hydrocarbon portion comprising hydrocarbons, a second hydrocarbon portion above the first hydrocarbon portion and comprising hydrocarbons, and a rock stratum between the first and second hydrocarbon portions, the rock stratum comprising water and rock, the apparatus comprising:

an antenna extending laterally within the hydrocarbon formation below and adjacent the first hydrocarbon portion; and a radio frequency (RF) power source coupled to the antenna and cooperating therewith to transmit RF energy into the hydrocarbon formation so that the first and second hydrocarbon portions are heated, water in the rock stratum is heated and steam is produced, and, fissures are created in the rock based upon the steam fracturing the rock, the fissures allowing heated hydrocarbons to flow through the rock stratum from the second hydrocarbon portion for recovery from the first and second hydrocarbon portions.

13. The apparatus of claim 12, wherein said antenna comprises an uninsulated linear dipole antenna.

14. The apparatus of claim 12, wherein said antenna comprises a conductively insulated linear dipole antenna.

15. The apparatus of claim 14, wherein said conductively insulated linear dipole antenna comprises a polytetrafluoroethylene insulated linear dipole antenna.

16. The apparatus of claim 12, wherein said antenna comprises an oil well pipe.

* * * * *